US008485049B2

(12) United States Patent
Yokoyama et al.

(10) Patent No.: US 8,485,049 B2
(45) Date of Patent: Jul. 16, 2013

(54) TORQUE TOOL DEVICE

(75) Inventors: Tetsuya Yokoyama, Tokyo (JP); Sinji Murayama, Tokyo (JP); Yasuhiro Yamamoto, Tokyo (JP); Satoshi Takaku, Tokyo (JP)

(73) Assignee: Tohnichi Mfg. Co., Ltd., Tokyo (JP)

( * ) Notice: Subject to any disclaimer, the term of this patent is extended or adjusted under 35 U.S.C. 154(b) by 327 days.

(21) Appl. No.: 12/452,082

(22) PCT Filed: Jun. 5, 2008

(86) PCT No.: PCT/JP2008/060349

§ 371 (c)(1),
(2), (4) Date: Feb. 24, 2010

(87) PCT Pub. No.: WO2008/155993

PCT Pub. Date: Dec. 24, 2008

(65) Prior Publication Data

US 2010/0170370 A1 Jul. 8, 2010

(30) Foreign Application Priority Data

Jun. 18, 2007 (JP) ..... 2007-160165
Jun. 18, 2007 (JP) ..... 2007-160166
Jun. 18, 2007 (JP) ..... 2007-160167

(51) Int. Cl.
*B25B 23/14* (2006.01)

(52) U.S. Cl.
USPC ..... 73/862.21

(58) Field of Classification Search
USPC ..... 73/862.21–862.23, 862.625
See application file for complete search history.

(56) References Cited

U.S. PATENT DOCUMENTS

| | | | | | |
|---|---|---|---|---|---|
| 2,792,733 | A * | 5/1957 | Walraven et al. | ..... | 81/481 |
| 2,887,921 | A * | 5/1959 | Livermont | ..... | 81/483 |
| 3,232,021 | A * | 2/1966 | Wilson | ..... | 52/507 |
| 3,236,127 | A * | 2/1966 | Knudsen et al. | ..... | 81/482 |
| 3,869,941 | A * | 3/1975 | Tsuji | ..... | 81/483 |
| 4,602,538 | A * | 7/1986 | Neuhaus | ..... | 81/467 |
| 5,617,766 | A * | 4/1997 | Tsuji et al. | ..... | 81/480 |
| 6,405,598 | B1 * | 6/2002 | Bareggi | ..... | 73/761 |
| 6,526,853 | B2 * | 3/2003 | Jenkins | ..... | 81/479 |
| 6,698,298 | B2 * | 3/2004 | Tsuji et al. | ..... | 73/862.21 |
| 7,934,428 | B2 * | 5/2011 | Schultz et al. | ..... | 73/761 |
| 7,984,657 | B2 * | 7/2011 | DeRose et al. | ..... | 73/862.333 |
| 2005/0092143 | A1 * | 5/2005 | Lehnert et al. | ..... | 81/469 |

FOREIGN PATENT DOCUMENTS

| | | | |
|---|---|---|---|
| JP | U-S62-184987 | | 11/1987 |
| JP | H07-105469 | A | 4/1995 |
| JP | H07-164343 | | 6/1995 |
| JP | H08-118251 | | 5/1996 |
| JP | 10-180645 | * | 7/1998 |
| JP | H11-212603 | | 8/1999 |
| JP | 2002-239939 | | 8/2002 |
| JP | 2005-118954 | * | 5/2005 |

(Continued)

*Primary Examiner* — Lisa Caputo
*Assistant Examiner* — Octavia D. Hollington
(74) *Attorney, Agent, or Firm* — Manabu Kanesaka

(57) ABSTRACT

The torque tool device includes a torque tool and an information processing terminal. The torque tool is capable of measuring the torque value at which a bolt or the like was tightened and then transmitting the measured torque value via wireless communication unit and the information processing terminal has information processing unit receiving the measured torque value and determining whether the torque value is acceptable.

16 Claims, 10 Drawing Sheets

FOREIGN PATENT DOCUMENTS

| | | | |
|---|---|---|---|
| JP | 2005-118955 | * | 5/2005 |
| JP | 2006-289535 | | 10/2006 |
| JP | 2006-293762 | | 10/2006 |
| JP | 2006-320984 A | | 11/2006 |

* cited by examiner

TORQUE TOOL DEVICE

TECHNICAL FIELD

The present invention relates to a torque tool device which includes a torque tool such as a torque wrench for tightening clamp members such as bolts and nuts, and a tightening information processing terminal for determining whether a measured torque value of the torque tool is a pre-set specified torque value. More particularly, the invention relates to the torque tool device that allows the torque tool and the tightening information processing terminal to communicate bidirectionally with each other by radio, thereby enabling the operator to know immediately whether the clamp member has been adequately tightened.

Furthermore, tightening data such as measured torque values of clamp members such as bolts is transmitted by radio to a processing terminal in conjunction with the manufacturer's serial number of a torque tool such as a torque wrench. This allows the tightening data and the data identifying the tightened clamp member such as a bolt to be controlled by the manufacturer's serial number of the torque tool, thereby providing traceability of the torque tool to the torque standard.

BACKGROUND ART

Some conventionally suggested torque tools such as torque wrenches are designed to measure the tightening torque of clamp members such as bolts or nuts (hereinafter referred to as the bolt) as they are tightened. When the measured torque value obtained has reached a specified torque value, the torque tool informs, by the lamp being lit, the buzzer being sounded, or a slight impact, the operator that the measured torque value obtained has reached the specified torque value.

In Patent Document 1, disclosed is a torque wrench which is capable of determining whether the measured torque value has reached the specified torque value, and then indicating the determination result to the operator. This torque wrench is designed such that specified torque values required are pre-entered at the setting portion and then stored in the internal memory. Then, when actual tightening is performed, it is determined whether the measured torque value has reached the specified torque value, and the result is outputted by the buzzer being sounded or via an LED. Accordingly, this torque wrench makes it possible for the operator to check whether the tightening was conducted with the correct torque value, thus allowing a bolt or the like to be tightened with a required torque.

Furthermore, a torque wrench has been conventionally used to tighten consecutively a number of clamp members such as bolts. In this case, there could be some bolts that were not tightened with a correct torque value or not tightened at all by mistake.

To overcome such problems, it is necessary to collect data such as the measured torque value provided when a bolt is tightened or the number of bolts tightened, and control the bolt tightening data.

As a related prior art, there is a data transfer device disclosed in Patent Document 2. Patent Document 2 describes an invention that relates to the data transfer device configured as follows. That is, the data transfer device is composed of: a torque wrench which has a processing circuit for accumulating data such as the measured torque value provided when bolts are tightened or the number of bolts tightened, and a transmitter for transmitting the data by radio; an interface for receiving the data transmitted from the torque wrench and displaying the received data; and a personal computer connected to the interface to record the received data for data processing and data control.

This invention can collect and control data such as measured torque values, thereby checking based on the recorded measured torque values whether the tightening has been adequately performed. It is also possible to check based on the number of the tightened bolts recorded whether there is any one left untightened.

[Patent Document 1] Japanese Patent Application Laid-Open No. 2006-289535

[Patent Document 2] Japanese Patent Application Laid-Open No. Hei. 8-118251

DISCLOSURE OF THE INVENTION

Problems to be Solved by the Invention

On one hand, the torque wrench described in Patent Document 1 can be used to tighten clamp members such as bolts with a correct torque. However, on the other hand, it becomes necessary to provide the torque wrench itself with input means for entering specified torque values required to tighten bolts or the like, determination means for determining whether the tightening torque is adequate, and a memory for storing measured torque values, etc. For this reason, the torque wrench would be increased in weight or provided with excessively massive accessories, e.g., too large to perform proper tightening operations with the wrench.

Furthermore, when the torque wrench needs to save data such as tightening torque, it is necessary to follow a saving procedure for every one tightening operation and a reset procedure for instructing the end of one tightening operation. Thus the data save procedure and the reset procedure must be carried out at every one tightening operation even when bolts or the like have to be tightened consecutively one after another. This therefore introduces a rather complicated step other than the tightening operation, thereby hindering a smooth progress of the tightening operation.

On the other hand, the conventional torque tool which transmits information by radio typically employs radio waves at frequencies of several tens of MHz to several hundreds of MHz band for wireless communications. For example, some torque tools utilize the 40 MHz band used such as for radio control or the 429 MHz band used such as for data transmissions. However, since different frequencies are allocated in different countries, those frequencies available in Japan cannot be always used all over the world.

Furthermore, for example, the wavelength of a frequency about 40 MHz is approximately 7.5 m. Therefore, even when an antenna having a length of ½ or ¼ the wavelength is used, a very long antenna is required and thus the torque tool cannot be reduced in size and weight.

Furthermore, the lower the frequency, the slower the communication speed becomes. This would lead to another problem that it takes a longtime to transmit information, thereby preventing tightening operations from being consecutively expedited.

Furthermore, the data transfer device described in Patent Document 2 can manage data such as measured torque values and the number of bolts tightened. However, to consecutively tighten a number of bolts using multiple torque wrenches in a factory line, the tightening data for each torque wrench needs to be put together at one place or consolidated into several management personal computers in order to facilitate the management of data. Additionally, to record tightening data of a plurality of torque wrenches at one place, it is necessary to identify which torque wrench provided each tightening data.

For example, when an inspection of a bolt tightened shows that the bolt was not tightened at an adequate torque value, it is necessary to check, from the data recorded in a management personal computer, which torque wrench was used for the tightening, and then inspect the relevant torque wrench.

However, if the tightening data cannot be distinguished by the torque wrench, the torque wrench cannot be identified.

Furthermore, if the torque wrench is given an arbitrary identification number and the tightening data is recorded in conjunction with the identification number, then it is possible to identify the torque wrench from the tightening data. However, even in this case, for example, the presence of torque wrenches having the same identification number or having an altered identification number different from its original one would make it difficult to identify which torque wrench provided the tightening data.

Furthermore, the tightening may not be adequately performed as described above conceivably because of the following reasons. That is, the operator who manipulates the torque wrench may not do so properly. Or the torque wrench itself may have some failure or malfunction, or the torque wrench tester for calibrating the torque wrench may have problems. If the torque wrench has a malfunction, the torque wrench needs to be identified and inspected with a torque wrench tester or the like, thereby being checked for the malfunction. On the other hand, if there is a problem with the calibrator or the torque wrench tester, then it is necessary to identify which torque wrench tester was used to calibrate which torque wrench.

Currently, the traceability system has been suggested as shown in FIG. 10 to ensure the accuracy or uncertainty of tightening torque realized by a torque tool such as a torque wrench, thereby assuring its reliability. This torque traceability system has at its top the National Standard Institute that provides standards for all the torque devices in Japan. The system includes the flow on the left of FIG. 10 which is made up of a length reference device and a reference torque wrench (Test lever) which have been calibrated by the National Standard Institute and are positioned in a lower layer to ensure the accuracy of length. The system also includes a weight as a mass reference device and the flow on the right of FIG. 10 which is made up of a weight and a balance whose accuracy is ensured by the weight to ensure the accuracy of mass. The system further includes a torque wrench tester calibrated by both the length and mass standard devices, and an end-use torque tool such as a torque wrench whose inspection and calibration are carried out by this torque wrench tester.

This system makes it possible to trace the following up to the level of the National Standard Institute in terms of which torque wrench tester or torque wrench checker was used to inspect the end-use torque wrench, and which reference device or reference torque wrench was used to calibrate the torque wrench tester and the torque wrench checker. This assures a certain level of accuracy for the torque realized by the tightening with the torque wrench so long as the torque wrench is inspected and calibrated within this traceability system.

However, as described above, unless which torque wrench provided the recorded tightening data is positively identified, it would not be possible to perform the inspection of the torque wrench that should be carried out at the time of an inspection using a torque wrench tester in a one-level higher layer. Additionally, which torque wrench tester was used to calibrate the torque wrench may not be identified. For these reasons, traceability cannot be ensured. It is thus now impossible to maintain effectively the traceability system suggested.

The present invention was developed to solve the aforementioned problems. It is therefore an object of the invention to provide a tightening-operation efficient torque tool device which can communicate bidirectionally by radio between a torque tool and a tightening information processing terminal, thereby eliminating the need for processing tightening information or providing settings for recording on the part of the torque tool. The torque tool device can instantly provide a determination result of whether a bolt or the like has been tightened adequately.

It is another object of the invention to provide a torque tool device having a torque tool reduced in size and weight.

It is still another object of the invention to provide a torque tool device which enables the use of particular frequency band radio waves for wireless communications by the torque tool device of the invention, thereby eliminating the need for changing the frequency even for use in other countries.

It is still another object of the invention to provide a torque tool device containing a torque tool such as a torque wrench which allows the construction of a traceability system that covers from an end-use torque wrench to national standards of torque. This may be realized by transmitting, to an information management terminal, such information that positively identifies which torque wrench provided the measured data when the torque wrench was used for the tightening.

Means for Solving the Problems

The torque tool device according to the present invention includes: a torque tool having torque measurement means for measuring a torque value at which a clamp member such as a bolt is tightened, first wireless communication means capable of transmitting information containing at least a measured torque value provided by the torque measurement means and receiving at least report information, and first report means for reporting based on the received report information; and a tightening information processing terminal having second wireless communication means capable of transmitting and receiving information to/from the first wireless communication means, information processing means for processing the information transferred from the second wireless communication means, and a pass/fail test section for making a pass/fail determination of whether the measured torque value contained in the information is a pre-set specified torque value. The torque tool device is characterized in that upon reception of the information transmitted from the first wireless communication means and containing at least the measured torque value, the tightening information processing terminal allows the pass/fail test section to conduct the pass/fail test and then the second wireless communication means to transmit the result of the pass/fail test as the report information to the first wireless communication means. The torque tool device is also characterized in that the first report means allows the first wireless communication means to report the result of the pass/fail test transmitted from the tightening information processing terminal.

Furthermore, the torque tool device according to the present invention includes: a torque tool having torque measurement means for measuring a torque value at which a clamp member such as a bolt is tightened, first wireless communication means capable of transmitting information over 2.4 GHz frequency band radio waves with the information including at least the measured torque value provided by the torque measurement means, and capable of receiving at least report information over 2.4 GHz frequency band radio waves, and first report means for reporting based on the received report information; and a tightening information processing terminal having second wireless communication means capable of transmitting/receiving information to/from the first wireless communication means over 2.4 GHz frequency band radio waves, information processing means for processing the information communicated from the second wireless communication means, and a pass/fail test section for making a pass/fail determination of whether the measured torque value contained in the information is a pre-set specified torque value. The torque tool device is characterized in that upon reception of the information transmitted from the first wireless communication means and containing at least the measured torque value, the tightening information processing terminal allows the pass/fail test section to conduct the pass/fail test and then the second wireless communication means to transmit the result of the pass/fail test as the report information to the first wireless communication means. The torque tool device is also characterized in that the first report means allows the first wireless communication means to report the result of the pass/fail test transmitted from the tightening information processing terminal.

Effects of the Invention

According to the torque tool device of the present invention, no means for conducting a pass/fail test of a measured torque value is available to the torque tool. It is thus not necessary to provide the torque tool with a processing device required for the pass/fail test or with storage means such as a memory for storing measured torque values and pass/fail test results. It is thus possible to minimize the number of component members of the torque tool, thereby reducing the torque tool in weight and size and providing improved operation efficiency.

Furthermore, the torque tool according to the present invention is configured only to transmit the measured torque value, receive the pass/fail test result, and report based on the pass/fail test result. This eliminates the need for the operator to do any manipulations associated with the storage or processing of tightening information during the tightening operation, thereby allowing for quickly performing tightening operations even when the tightening operations are being carried out consecutively.

In particular, to tighten a clamp member such as a bolt with a torque wrench serving as a torque tool having a toggle mechanism, the operator has only to continue the operation until the toggle mechanism is activated. The operator can do the tightening operation without paying particular attention to the torque value during the current tightening operation. Then, the operator can immediately recognize from the report on the pass/fail test result whether the tightening torque was adequate, thereby improving the efficiency of the tightening operation of a clamp member such as a bolt as well as performing a tightening operation at a highly accurate torque value.

Furthermore, the 2.4 GHz band, radio waves used for wireless communications between the torque tool and the tightening information processing terminal in the torque tool device according to the present invention are one of the ISM bands or a frequency band which can be used commonly in all the countries all over the world. Therefore, the torque tool device according to the present invention which uses the 2.4 GHz frequency band can be advantageously used in any countries so long as they use the 2.4 GHz band as an ISM band.

Furthermore, when compared with conventional ones using several tens of MHz to several hundreds of MHz band radio waves, the torque tool device provides communications at much higher speeds. This shortens the time required until the pass/fail test result is received from the information processing terminal and then reported after the torque value has been transmitted from the torque tool, thereby improving the operation efficiency. Furthermore, this shortening of the transmit and receive time can reduce power consumption, thus advantageously extending the battery life time.

Furthermore, the torque tool device according to the present invention is configured such that the manufacturer's serial number unique to each torque wrench is transmitted from the torque wrench to the information processing terminal, allowing the tightening data such as measured torque values to be recorded corresponding to the manufacturer's serial number in an information management personal computer. It is thus possible to identify positively which torque wrench provided the tightening data. Furthermore, by enabling it to identify which torque wrench was used to tighten a clamp member such as a bolt tightened, it is possible to construct a traceability system from the tightened clamp member to the National Standard Institute of torque.

DESCRIPTION OF THE REFERENCE NUMERALS

Figure 1:
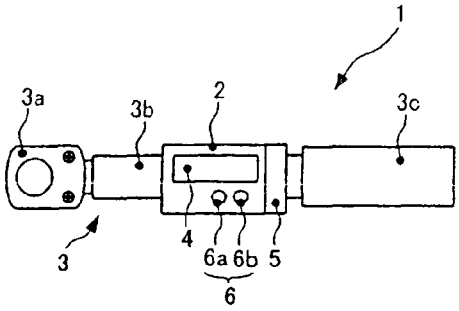
FIG. 1 is a schematic view illustrating a torque tool device of the present embodiment which includes a torque wrench 1 and an information processing terminal 20.
Figure 1:
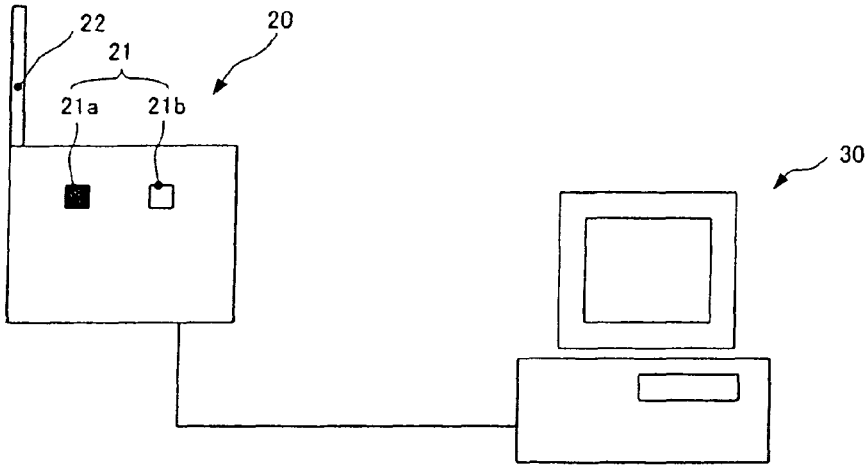

1 Torque wrench
2 Case
3 Torque wrench body
4 Liquid crystal display unit
5 Antenna
6 LED
**6*a*** Green LED
**6*b*** Red LED
7 Toggle mechanism
8 Radio module
9 CPU
11 Hall element
12 Strain gauge
13 Permanent magnet
14 Spring

20 Information processing terminal
21 LED
21*a* Green LED
21*b* Red LED
22 Antenna
24 Radio module
25 CPU
25*a* Pass/fail test section
26 Specified-value memory
30 Externally connected device

BEST MODE FOR CARRYING OUT THE INVENTION

A description will now be made to an embodiment of a torque tool device according to the present invention with reference to the drawings.

(First Embodiment)

Figure 2:
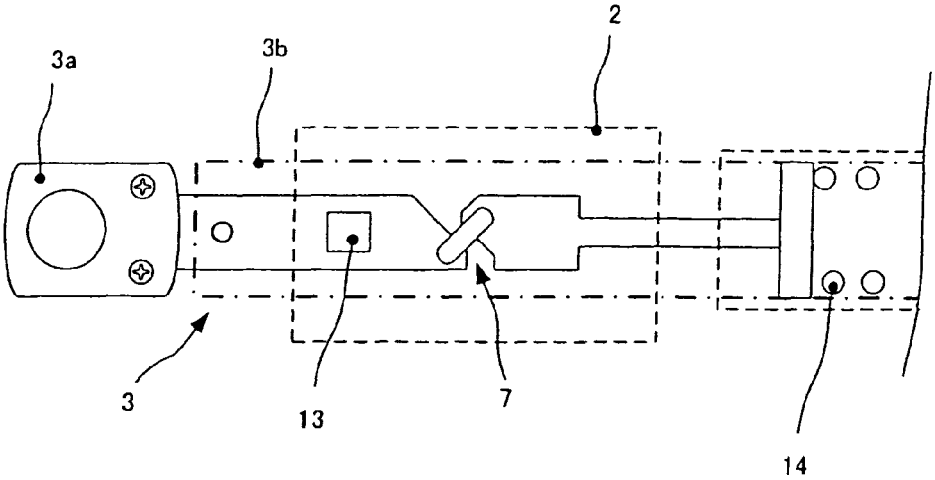
FIG. 2 is a view illustrating the configuration of the torque wrench 1 shown in FIG. 1.
Figure 3:
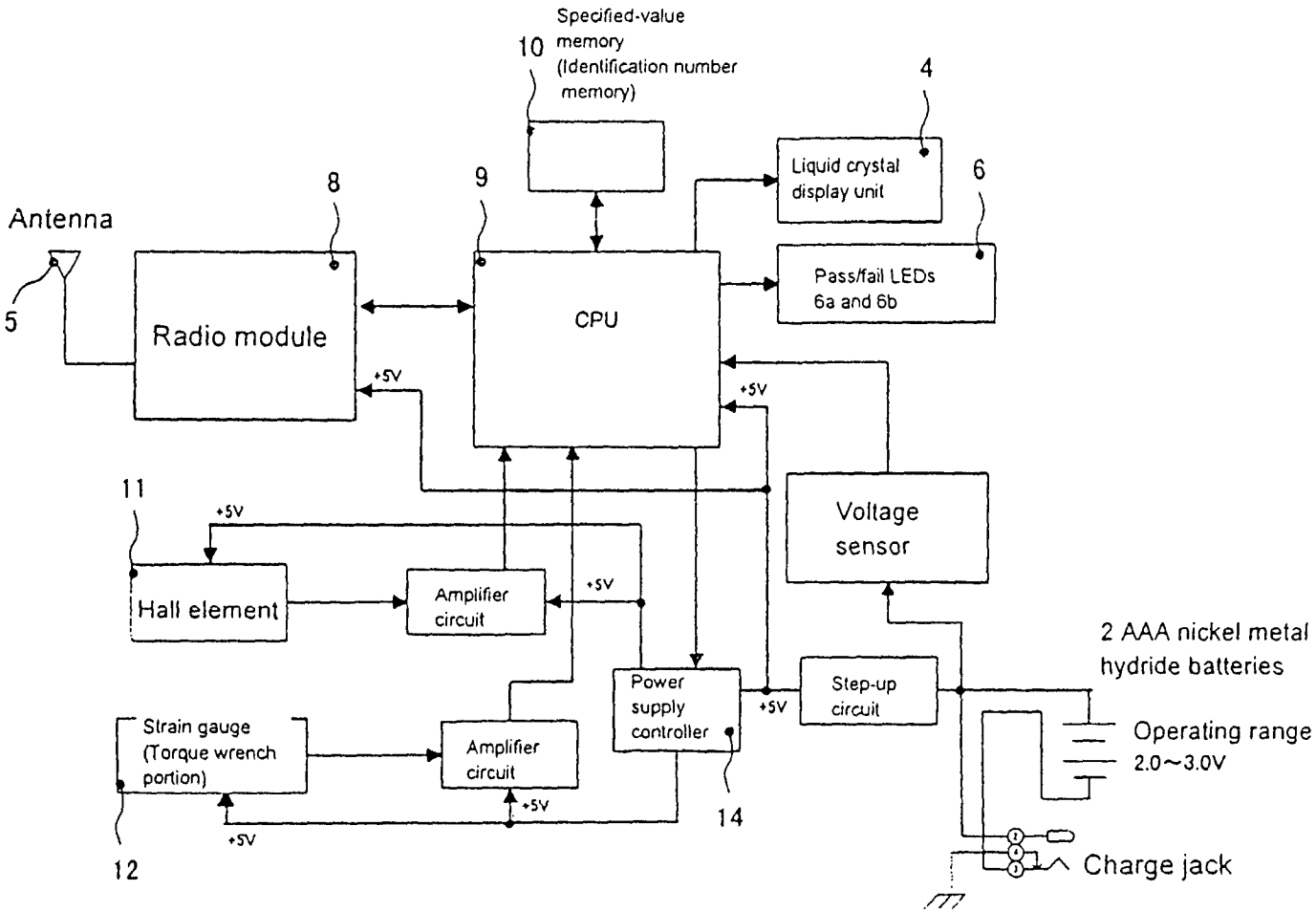
FIG. 3 is a circuit diagram of the torque wrench 1 shown in FIG. 1.
Figure 4:
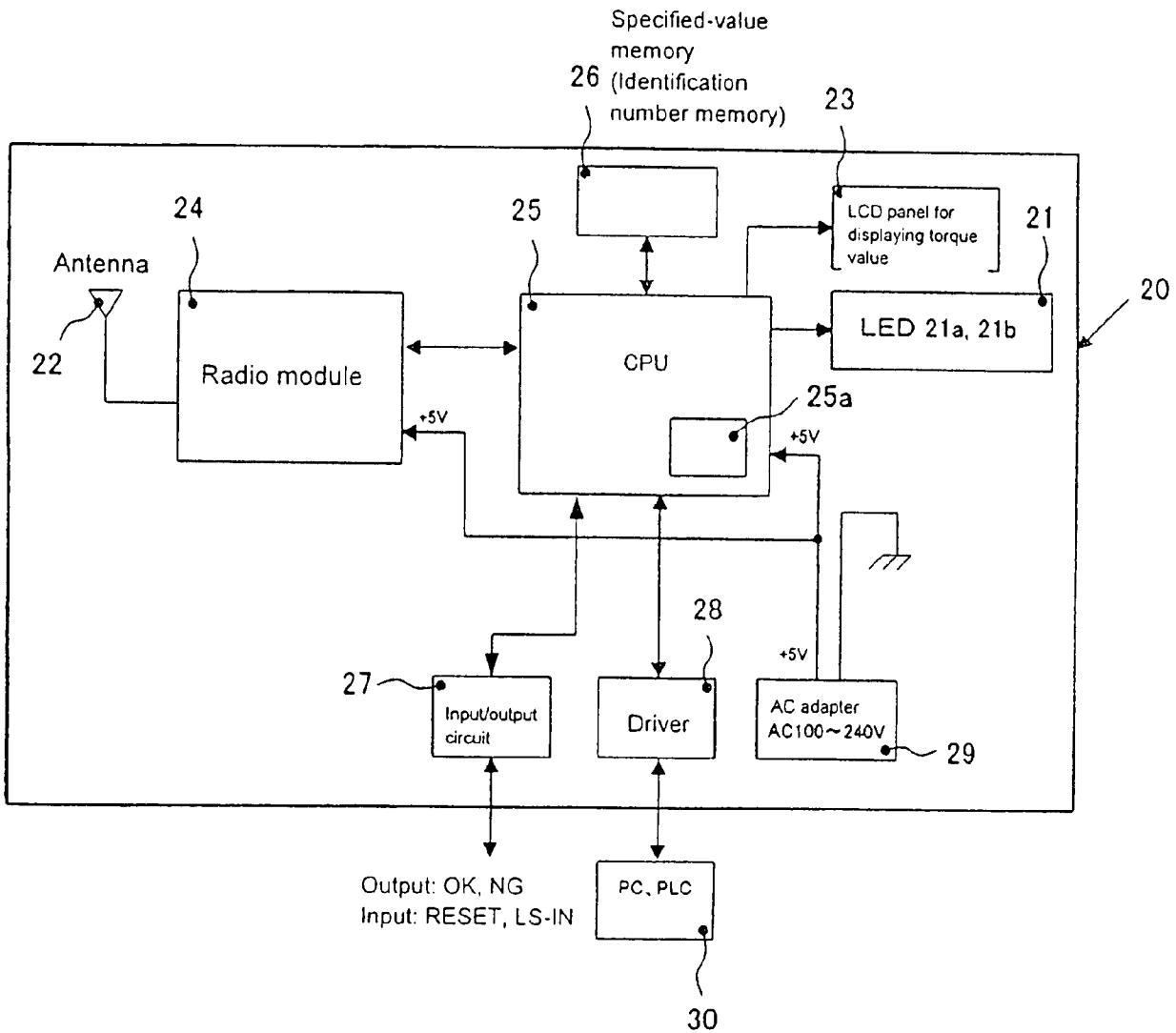
FIG. 4 is a circuit diagram of the information processing terminal 20 shown in FIG. 1.

FIG. 1 is a schematic view illustrating a torque tool device according to a first embodiment of the present invention. The torque tool device of the present embodiment is made up of a torque tool or a torque wrench 1 and a tightening information processing terminal (hereinafter referred to as the processing terminal) 20. FIG. 2 is a view illustrating the configuration of the torque wrench 1, FIG. 3 is a circuit diagram of the torque wrench 1, and FIG. 4 is a circuit diagram of the processing terminal 20.

The torque tool device shown in FIG. 1 according to the first embodiment works as follows. The torque wrench 1 tightens clamp members such as bolts (hereinafter bolts will be described as an example), and then information containing the measured torque value provided when the tightening is completed is transmitted to the processing terminal 20. The processing terminal 20 receives the information containing the measured torque value, and then allows a pass/fail test section to make a pass/fail determination of whether the measured torque value is a pre-set specified torque value (within the range of the upper and lower limits with respect to the specified torque value). If the measured torque value is the specified torque value, then the measured value is determined to have passed the test (Good as the result of the pass/fail test). If the measured value is out of the specified value, then the measured value is determined to have failed the test (NG as the result of the pass/fail test). The processing of the pass/fail test will be described later in more detail.

Then, after the aforementioned pass/fail test, the processing terminal 20 transmits the pass/fail test result to the torque wrench 1, so that the torque wrench 1 allows report means to inform the operator of the pass/fail test result. This allows the operator to determine immediately whether the bolt has been adequately tightened. Furthermore, in conjunction with the transmission of the pass/fail test result, the processing terminal 20 can also externally output information containing, for example, the torque value and its pass/fail test result to an externally connected device 30 which includes a personal computer (PC) or a programmable controller (PLC). Thus, the externally outputted information can be controlled or analyzed on the personal computer or the like.

Note that as will be described later, the specified torque value serving as the criterion for the pass/fail test is specified in practice as a range determined by the lower and upper limits within which the specified torque value falls. Thus, any measured torque value within the range is determined to have passed the test. This specified torque value can be pre-set according to a required tightening torque value at the processing terminal 20 or the externally connected device 30 to be connected to the processing terminal 20.

Furthermore, the torque tool device of the first embodiment transmits or receives the information containing the measured torque value and the pass/fail test result between the torque wrench 1 and the processing terminal 20 using the ISM band or 2.4 GHz band radio frequency. This makes it possible to provide higher-speed communications than by several tens of MHz to several hundreds of MHz band radio waves. Thus, even when an external device such as the processing terminal 20 is used to carry out the pass/fail test, there is substantially no time lag caused by wireless communications, so that the determination result can be obtained almost at the same time the tightening is finished. Accordingly, there is no degradation in operation efficiency due to wireless communications.

Furthermore, it is preferable to employ the frequency hopping scheme for wireless communications between the torque wrench 1 and the processing terminal 20 so that radio waves are transmitted and received between the torque wrench 1 and the processing terminal 20 at frequencies which are changed rapidly under certain rules. Even when the transmission frequency is being used by another wireless device or noise is occurring at the same frequency as the transmission frequency, the use of the frequency hopping scheme enables successful communications at a different frequency from that transmission frequency, thus contributing to reduction in communication errors.

As described above, the torque wrench 1 has only to include tightening torque measurement means, wireless communication means, and pass/fail test result report means. This allows for reducing in size the electric apparatus that is made up these members attached to the torque wrench 1. Furthermore, since all the information such as torque values is processed at the processing terminal 20, no manipulation will be required for data processing such as recording of measured values on the part of the torque wrench 1. Accordingly, the operator is required to perform only two actions including the tightening of a bolt and the checking of the pass/fail test result reported. On the other hand, the use of 2.4 GHz band radio waves enables high-speed communications, thereby providing further improvements in operation efficiency.

A description will now be made to the specific configuration of the torque wrench 1 and the processing terminal 20.

The torque wrench 1 is made up of a head 3*a*, to which a socket (not shown) is attached to engage with a bolt or nut, a torque wrench body 3 including a hollow handle 3*b* and a grip 3*c*, and a torque wrench circuit section shown in FIG. 3.

The torque wrench circuit section includes: a CPU 9 for controlling the entire circuit; torque measurement means including a strain gauge 12 disposed inside the handle 3*b* for measuring strain and the CPU 9; first wireless communication means including an antenna 5 and a radio module 8 (and the CPU 9); and pass/fail report means or a pass/fail LED 6 (including a green LED 6*a* and a red LED 6*b*). This torque wrench circuit section further includes an identification number memory 10 for storing the identification number of the torque wrench 1 and a liquid crystal display unit 4 composed of an LCD panel for displaying torque values. The CPU 9 allows a voltage sensor to sense the voltage of a power supply battery (with an operative range of 2.0 to 3.0 V). The CPU 9 also allows a step-up circuit to multiply the voltage of the power supply battery (to 5 V) for supply to the CPU 9 and the radio module 8, and allows the voltage controlled by a power supply controller to be supplied to each amplifier circuit, a Hall element 11, and a strain gauge 12. Note that the signals detected at the Hall element 11 and the strain gauge 12 are amplified at the respective amplifier circuits for supply to the CPU 9. Furthermore, the power supply battery can be charged by connecting its charge jack to an external power supply.

The identification number defined at the identification number memory 10 can be, e.g., an in-house serial number which the user can set at will to the torque wrench. The in-house serial number is read into the CPU 9 when the main switch (not shown) is turned ON, and then transmitted to the processing terminal 20 by the first wireless communication means in conjunction with the measured torque value.

Then, on the part of the torque wrench circuit section, when the first wireless communication means receives the pass/fail test information from the processing terminal 20, the CPU 9 activates the pass/fail LED 6 according to the pass/fail status. That is, the green LED 6*a* is turned ON for a pass status, whereas the red LED 6*b* is turned ON for a fail status. Note that the signal transmitted from the processing terminal 20 contains the identification number in conjunction with the information on the pass/fail test result, so that only when the identification number in the received signal is relevant, the CPU 9 activates the pass/fail LED 6 according to the received information on the pass/fail test result.

Furthermore, as shown in FIG. 2, the head 3*a* and the handle 3*b* of the torque wrench body 3 are coupled to each other inside the handle 3*b* by means of a toggle mechanism 7 to be described later.

Furthermore, each circuit such as the CPU 9, the radio module 8, and the Hall element 11 for sensing the operation of the torque wrench 1 is disposed in a metal case 2 installed in the torque wrench body 3. Furthermore, the LED 6 serving as the report means and the liquid crystal display unit 4 for displaying torque values are disposed on the surface of the case 2. Note that although the antenna 5 is disposed outside the case 2 in the first embodiment, it may also be included inside the case 2 when the case is formed of a material that do not shield radio waves (or a non electromagnetic shielding material).

The aforementioned toggle mechanism 7 serves to couple the head 3*a* to the inside of the handle 3*b*. When the torque wrench 1 starts to be used to tighten a clamp member such as a bolt with its tightening torque being increased, the toggle mechanism 7 starts to operate causing the relative pivotal motion of the head 3*a* and the handle 3*b*. When the tightening torque value has reached the given specified torque value, the toggle mechanism 7 is activated causing the handle 3*b* to take an abrupt pivotal motion with respect to the head 3*a* in conjunction with a slight shock, so that the rigid coupling of the head 3*a* and the handle 3*b* is released. The slight shock causes the operator to recognize that the predetermined torque value has been reached, thereby allowing him/her to release the tightening instantly before the tightening torque becomes too excessive.

The torque value at which the toggle mechanism 7 is activated can be changed by adjusting the energizing force of a toggle spring 14 for energizing the toggle mechanism 7.

Here, the aforementioned toggle mechanism 7 has a well-known structure that has been conventionally employed for torque wrenches. That is, the toggle mechanism 7 is made up of a front actuation body to be connected to the rear end portion of the head 3*a*; a rear actuation body disposed inside the handle 3*b* to be energized forwardly by the toggle spring 14 disposed at the rear end side of the handle 3*b*; and a coupling pin for coupling between the front actuation body and the rear actuation body. The opposing faces of the front actuation body and the rear actuation body are formed as inclined planes that are parallel mutually with respect to the axial direction of the handle 3*b*. Note that the rear end portion of the head 3*a* is inserted into the handle 3*b* and made shakable by a pivot pin relative to the handle 3*b*.

The toggle mechanism 7 configured as described above works such that when a bolt is tightened by a pivotal motion of the handle 3*b*, a reactive force acting upon the head 3*a* as the tightening torque increases causes the front actuation body to energize the toggle spring 14 via the coupling pin, which in turn causes the rear actuation body to retreat. Furthermore, the rear actuation body retreating causes the front actuation body to be shaken via the coupling pin, thereby releasing the rigid coupling of the front actuation body and the rear actuation body. A slight shock generated upon releasing the rigid coupling serves for the operator to recognize that the given torque value has been reached.

Note that the front actuation body of the toggle mechanism 7 is provided with a permanent magnet 13, and the Hall element 11 (not shown) is disposed at a location corresponding thereto inside the case 2. When the toggle mechanism 7 is activated, the permanent magnet 13 and the Hall element 11 come closer to each other to generate a voltage, which serves to sense the operation of the toggle mechanism 7. That is, the Hall element 11 functions as a switch to sense the operating status of the toggle mechanism. The Hall element 11 senses the status in which the toggle mechanism 7 is set at the normal position under its rigid coupling condition and the output voltage from the Hall element 11 is lower than a predetermined voltage (switch OFF status). The Hall element 11 also senses the operating status of the toggle mechanism 7 in which the toggle mechanism is offset from the normal position and the output voltage is above the predetermined voltage (switch ON status).

The processing terminal 20 is made up of information processing means including a CPU 25 having a pass/fail test section 25*a* for performing the aforementioned pass/fail test and a specified-value memory 26 for storing specified torque values; second wireless communication means including, for example, an antenna 22 and a radio module 24; and second report means or an LED 21 (a green LED 21*a* and a red LED 21*b*). Furthermore, the specified-value memory 26 stores the identification number of torque wrenches. In the present embodiment, the CPU 25 determines whether the identification number of the torque wrench read from the specified-value memory 26 is consistent with the torque wrench identification number in the received information obtained by the second wireless communication means.

Furthermore, the processing terminal 20 uses an AC adaptor 29 as its power supply. Furthermore, the terminal 20 is connected to the externally connected device 30 via a driver 28, and allows an input/output circuit 27 to output, for example, the pass/fail test result (Good or NG) from the CPU 25 to outside and to input, for example, a reset command to the CPU 25.

Note that as described above, the first and second wireless communication means of the torque wrench 1 and the processing terminal 20 according to the first embodiment are wireless communication means that can communicate bidirectionally over the 2.4 GHz frequency band radio waves.

Figure 5:
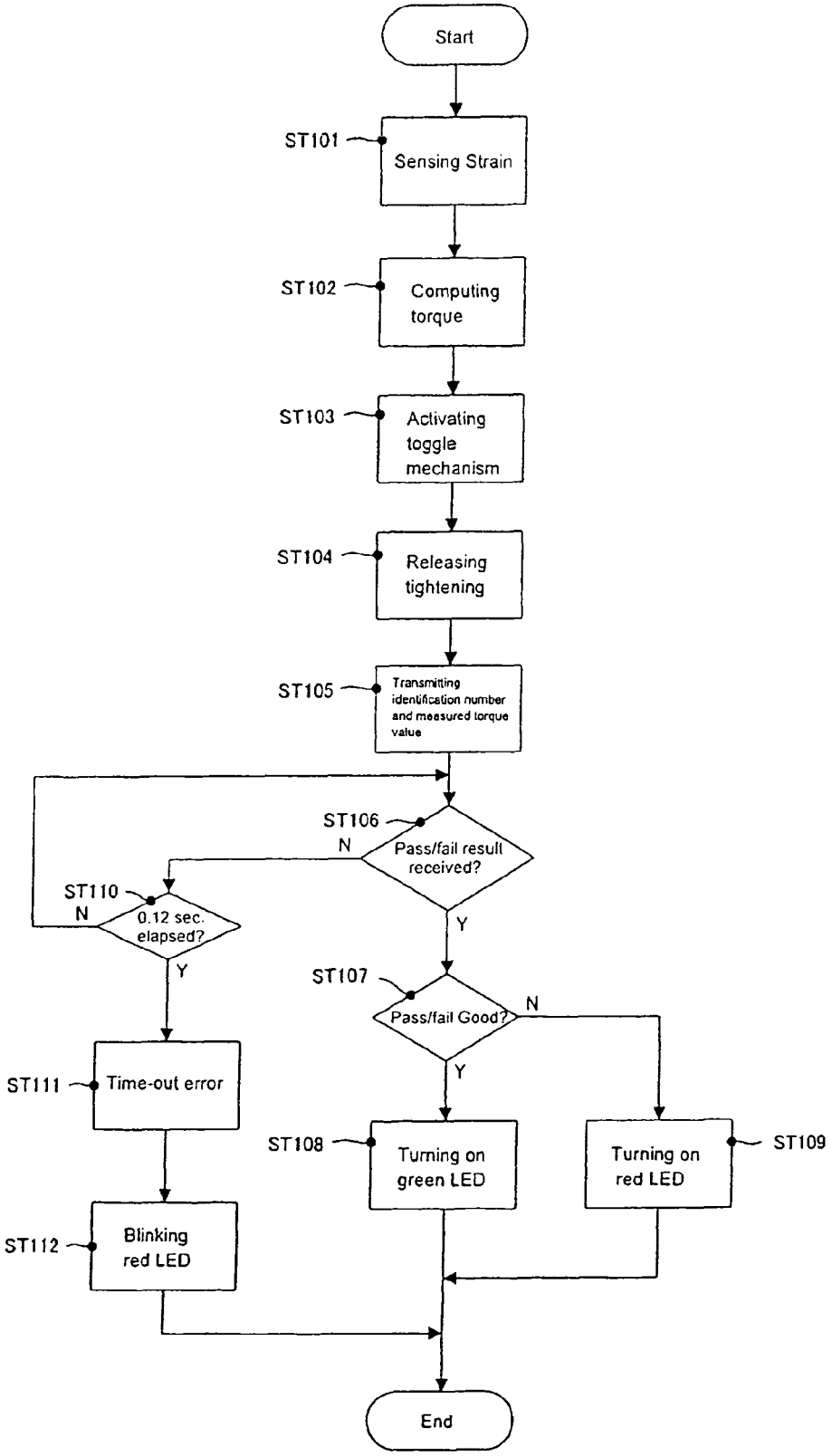
FIG. 5 is a flowchart illustrating the operation of the torque wrench 1 shown in FIG. 1.
Figure 6:
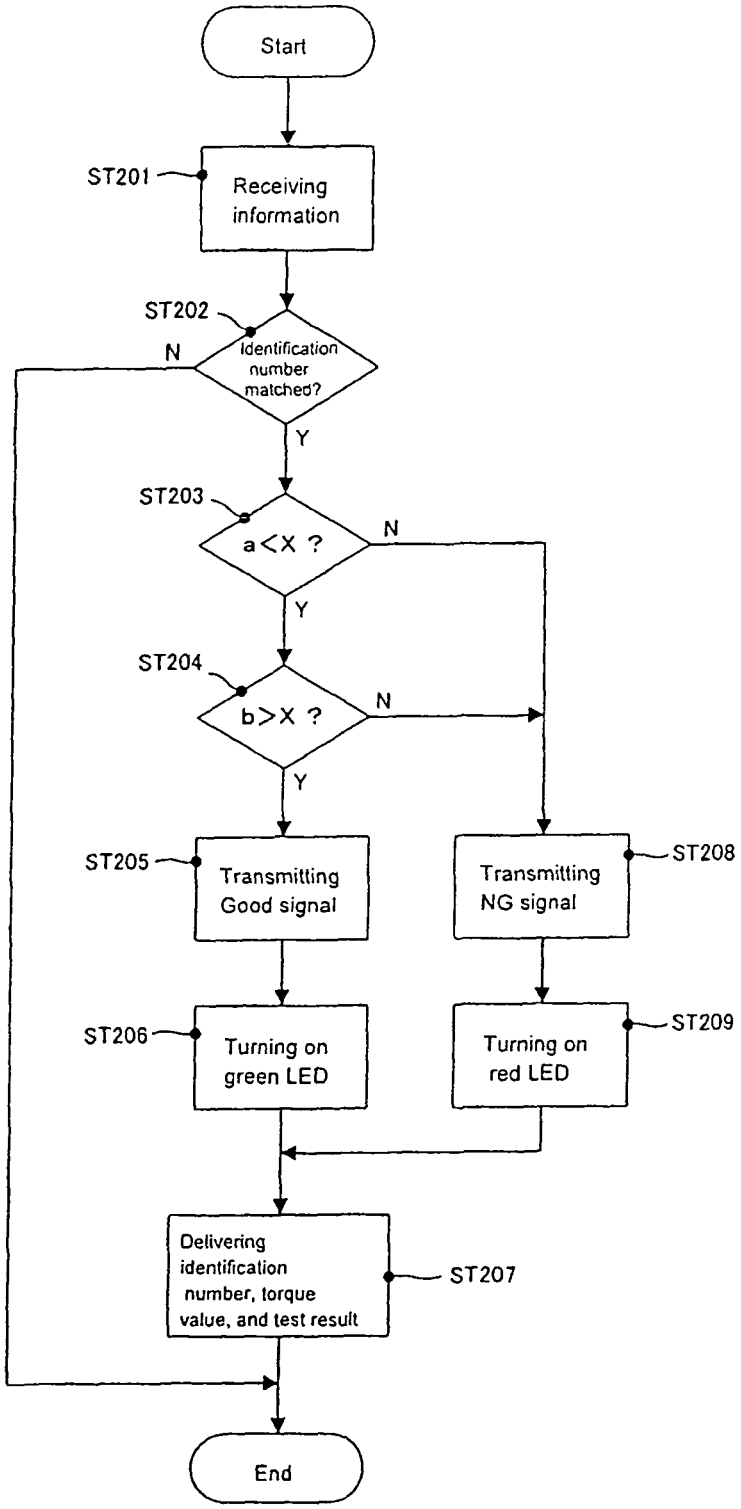
FIG. 6 is a flowchart illustrating the operation of the information processing terminal 20 shown in FIG. 1.

With reference to the flowcharts shown in FIG. 5 and FIG. 6, a description will now be made to the operation and processing of the torque wrench 1 and the processing terminal 20 that are configured as described above.

First, the flow of operation of the torque wrench 1 shown in FIG. 5 will be described.

First, when the torque wrench 1 is used to tighten a bolt, the strain gauge 12 senses the strain generated by the tightened force (step ST (hereinafter denoted as ST) 101). Then, the CPU 9 computes the torque value from the strain sensed by the strain gauge 12 (ST102). After that, the toggle mechanism 7 is activated (ST103) for the operator to stop the tightening.

Then, when the CPU 9 determines that the tightening by the torque wrench 1 has been released (ST104), the maximum torque value (peak torque value) of the input torque values or the measured torque value and the identification number of the torque wrench 1, for example, its in-house serial number are transmitted to the processing terminal 20 by the first wireless communication means (ST105). The transmission process is ended at this point. The torque value computed during the tightening can be displayed at any time on the liquid crystal display unit 4.

Note that the torque wrench 1 of the first embodiment uses the output voltage from the Hall element 11 to sense the normal position condition of the toggle mechanism 7 (a switch OFF status) and the operating status of the toggle mechanism 7 (a switch ON status) which is reached by the operator starting tightening. When the operator stops the tightening thereby causing the toggle mechanism 7 to be brought back to the normal position (a switch OFF status), the CPU 9 then determines that the tightening has been released, thus putting an end to one tightening operation with the torque wrench 1.

Furthermore, the torque value transmitted to the processing terminal 20 in ST105 is the measured torque value or the maximum torque value (the peak torque value) of those measured until the toggle mechanism 7 started and the aforementioned switch ON status was reached. Accordingly, unless the output voltage from the Hall element 11 exceeds the predetermined voltage and the switch ON status is achieved, the torque value is not transmitted to the processing terminal 20. Thus, even if the strain gauge 12 has sensed a microscopic strain, the pass/fail test will not be carried out each time it is sensed.

A description will now be made to how the torque wrench 1 processes received information. While the torque wrench 1 is waiting for wireless communications from the processing terminal 20 after having transmitted information such as the peak torque value (ST106), it may receive a pass/fail test result. In this case, the CPU 9 judges the received pass/fail test result (ST107). If the pass/fail test result Good indicating that the measured torque value was a specified torque value was received, the process proceeds to ST108, where the green LED 6*a* is lit. On the other hand, if the measured torque value was out of the specified torque value and therefore the pass/fail test result NG (No Good) was received, the process proceeds to ST109, where the red LED 6*b* is lit.

Furthermore, if a pass/fail test result is not received in ST106, the process proceeds to ST110, where it is determined whether 0.12 seconds have elapsed after the identification number and the peak torque value were sent in ST105. If 0.12 seconds have not yet elapsed, then the process repeats ST106 and ST110. If, however, 0.12 seconds have elapsed, the process determines that the communication with the processing terminal 20 was not established. The CPU 9 thus judges that there occurred a time-out error (ST111), then blinking the red LED 6*b* (ST112) and subsequently terminating the process. The blinking of the red LED 6*b* allows the operator to recognize that the wireless communication between the torque wrench 1 and the processing terminal 20 was not conducted successfully.

Note that in the torque tool device of the present embodiment, it takes a certain time to perform tightening with the torque wrench 1, then transmit the measured torque value to the processing terminal 20, conduct the pass/fail test by the processing terminal 20, and finally turn on the LED 6 in the torque wrench 1. The time required may vary depending on the communication speed but is about 12 milliseconds. In the first embodiment, when the result is not received after 0.12 seconds elapsed, the process determines that some trouble has occurred and issues a time-out error. However, this predefined time is not limited to 0.12 seconds but may also be set arbitrarily.

On the other hand, information may be transmitted and received between the torque wrench 1 and the processing terminal 20 not by the 2.4 GHz band radio waves but by several tens of MHz to several hundreds of MHz ordinary radio waves. In this case, it will take a different period of time to perform tightening with the torque wrench 1, then transmit the measured torque value to the processing terminal 20, carry out the pass/fail test at the processing terminal 20, and finally turn on the LED 6 in the torque wrench 1. That is, the time required may vary depending on the communication speed but is typically about 0.5 seconds. In this case, if the pass/fail test result is not received when 1 second or more elapsed after information was sent from the torque wrench 1 to the processing terminal 20, then the process determines that some trouble has occurred and issues a time-out error.

The descriptions above show the flow on the part of the torque wrench 1 from the measured torque value to the pass/fail test result being reported.

A description will now be made to the processing by the processing terminal 20 shown in FIG. 6. The processing terminal 20 receives, from the torque wrench 1, information containing its identification number and measured torque value via the second wireless communication means such as the antenna 22 (ST201). Then, the CPU 25 determines whether the received identification number is to be subjected to the pass/fail test at the processing terminal 20 (ST202). If the received identification number matches a registered number, the process proceeds to the subsequent pass/fail test. If the received identification number is not a registered one, the process discards the received information without the pass/fail test and then ends.

If the received identification number matches a registered number, the pass/fail test section 25*a* of the CPU 25 determines whether the received torque value is a specified torque value stored in the specified-value memory 26 of the processing terminal 20.

More specifically, it is first determined whether $a<X$, where "a" is the lower limit of the specified torque value with "b" being the upper limit, and X is the received torque value. That is, it is determined whether the received measured torque value is greater than the acceptable lower limit (ST203).

When it was determined in ST203 that the measured torque value received was greater than lower limit "a", the process proceeds to ST204, where it is determined whether the measured torque value received is less than the acceptable upper limit. That is, it is determined whether $b>X$. Then, if the torque value X is less than b, the process determines Good as the result of the pass/fail test. In this case, the information of the Good as the result of the pass/fail test is transmitted to the torque wrench 1 (ST205), and the green LED 21*a* is turned on to show Good as the result of the pass/fail test at the processing terminal 20 (ST206).

On the other hand, if it is determined in ST203 that the measured torque value X received is equal to or less than the acceptable lower limit "a" and in ST204 that it is equal to or greater than the upper limit "b", the measured torque value is out of the specified torque value and thus determined to be NG as the result of the pass/fail test. Then, the information of the NG as the result of the pass/fail test is transmitted to the torque wrench 1 (ST208), while the red LED 21*b* of the processing terminal 20 is turned on (ST209). Note that in the first embodiment, 2.4 GHz band frequency radio waves are used to receive information such as the measured torque value from the torque wrench 1 or to transmit the pass/fail test result to the torque wrench 1.

Now, in ST207, after either one of the aforementioned pass/fail test results is transmitted to the torque wrench 1 and the LED 21 is turned ON, the checked identification number, the measured torque value, and the determination result are externally output to the externally connected device 30 for storage. The descriptions above show the flow of processing at the processing terminal 20.

Note that if the received measured torque value and pass/fail test result need not to be recorded, the externally connected device 30 is not required to connect to the processing terminal 20, and thus ST207 is eliminated. In this case, the information such as torque values cannot be accumulated, but only the pass/fail test can be carried out at the processing terminal 20.

Figures 1, 7:
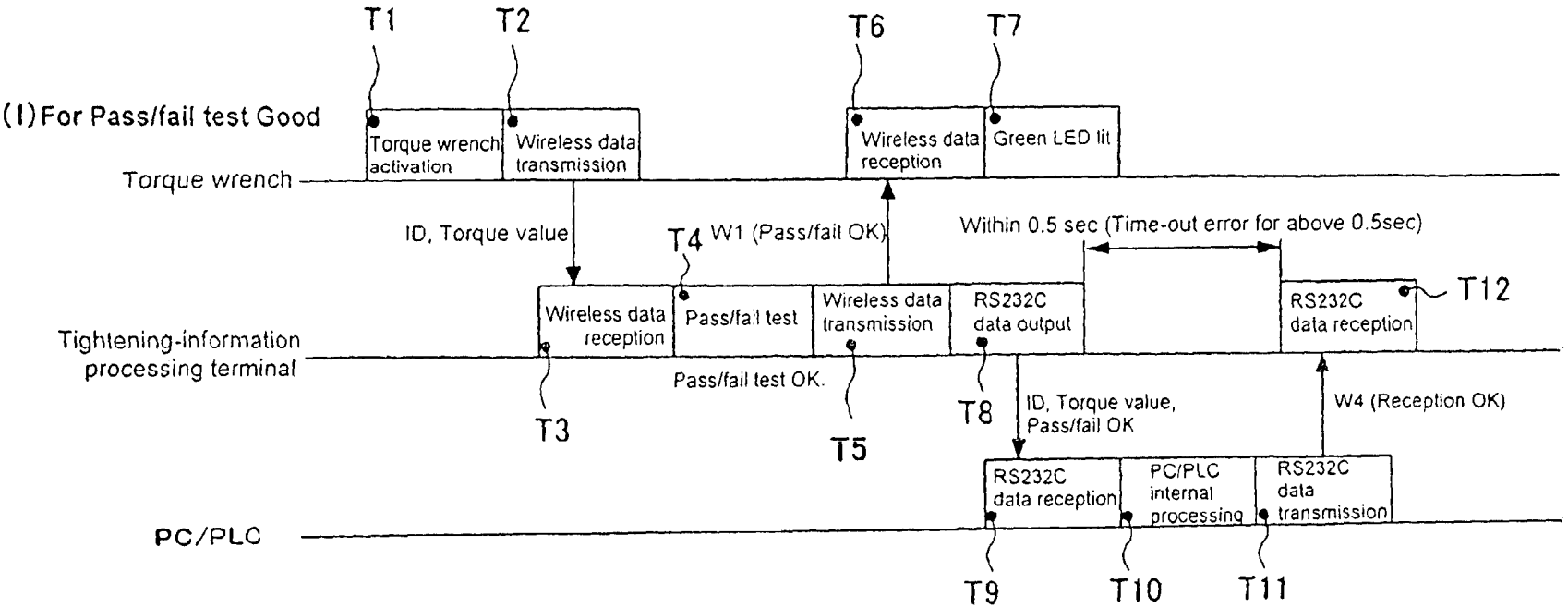
FIG. 7 is a timing chart illustrating the operation of the torque tool device shown in FIG. 1.
Figures 2, 7:
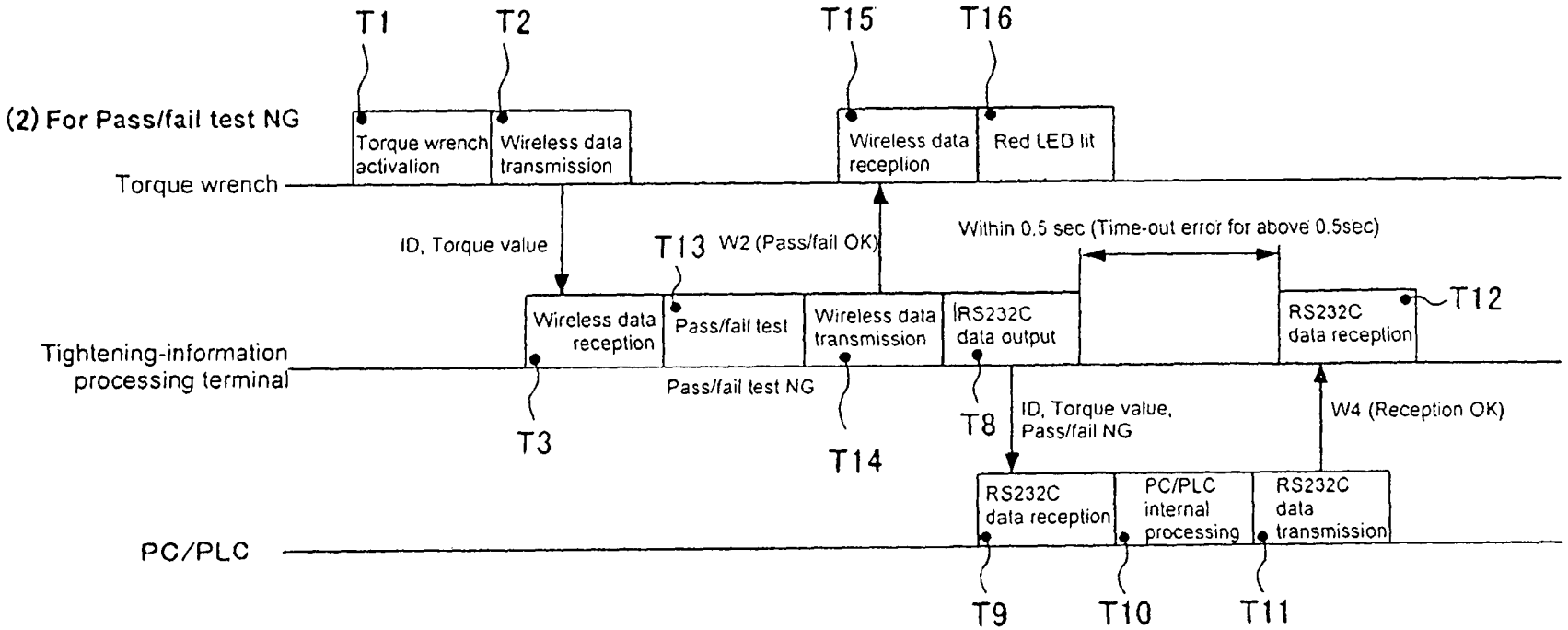

With reference to the timing chart shown in FIG. 7, a description will now be made in the temporal sequence to the timing of each operation which is performed by the torque wrench 1 and the processing terminal 20. FIG. 7 shows the timing chart of the operations of the torque wrench 1, the processing terminal 20, and the externally connected device 30 in each of cases (1) and (2): (1) when the measured torque value is a specified torque value (in the case of Good as the result of the pass/fail test) and (2) when the measured torque value is out of the specified torque value (in the case of NG as the result of the pass/fail test).

First, a description will be made to the operation of the torque wrench 1 and the processing terminal 20 in the case of (1) with Good as the result of the pass/fail test. When the torque wrench 1 is used to start tightening a bolt, a torque value is measured at time T1 (T1), and the information containing the measured torque value and the identification number of the torque wrench 1 is transmitted from the torque wrench 1 to the processing terminal 20 (T2). After having received the aforementioned information (T3), the processing terminal 20 first determines based on the identification number whether the information is to be subjected to the pass/fail test. If the identification number received is determined to be subjected to the pass/fail test, then the pass/fail test section 25*a* makes a pass/fail determination of whether the measured torque value is a specified torque value (T4). If it is as indicated in (1), the measured torque value lies within the range acceptable as the specified torque value, thus providing Good as the result of the pass/fail test. Then, the processing terminal 20 transmits this pass/fail test result to the torque wrench 1 (T5). When the torque wrench 1 receives the pass/fail test result transmitted (T6), the green LED 6*a* is turned on indicating Good as the result of the pass/fail test (T7).

Now, a description will be made to NG as the result of the pass/fail test shown in (2). The operations performed until the processing terminal 20 conducts the pass/fail test are the same as those in the case of Good as the result of the pass/fail test shown in (1) (T1 to T3). Then, in the case shown in (2), the measured torque value is out of the range acceptable as the specified torque value, and thus the pass/fail test section 25*a* provides NG as the result of the pass/fail test (T13). The processing terminal 20 transmits this determination information to the torque wrench 1 (T14), and the torque wrench 1 receives the determination information (T15), turning on the red LED 6*b* indicating NG as the pass/fail test result (T16).

The descriptions above show the operations of the torque wrench 1 and the processing terminal 20 and the flow of information communicated. Note that the operation from time T8 to T12 is to externally output the information containing the measured torque value and the identification number from the processing terminal 20 to the externally connected device 30. This externally output processing can also be regarded as a time-out error, as with the time-out error at the aforementioned torque wrench 1, if it has not been carried out within a specified period of time (for example, within 0.5 seconds). In the case of the time-out error, the red LED 21*b* of the processing terminal can be blinked to inform the operator of it. On the other hand, if no externally output processing is performed, the processing from T8 to T12 is eliminated.

As can be seen from above, the information communication by the torque tool device of the first embodiment is such that when the measured torque value is transmitted from the torque wrench 1 to the processing terminal 20, the processing terminal 20 conducts the pass/fail test, and the information on the pass/fail test result is sent back to the torque wrench 1. Accordingly, there is no need to receive or transmit an additional signal to check to see if the information communication has been established, i.e., whether the communication from the torque wrench 1 to the processing terminal 20 has been successfully performed, and whether the processing terminal 20 has communicated successfully with the torque wrench 1. It is thus possible to employ the indication of the pass/fail test result provided by the LED 6 being lit at the torque wrench 1 to check the pass/fail test result as well as the accomplishment of the communication between the torque wrench 1 and the processing terminal 20.

Note that in the present embodiment, 2.4 GHz band radio waves are used as described above to transmit and receive radio waves between the torque wrench 1 and the processing terminal 20 at times T2 and T3, T5 and T6, and T14 and T15. Furthermore, for the communications at those times, it is preferable to transmit and receive the radio waves by the frequency hopping scheme. That is, the frequency hopping scheme can prevent communication errors between the torque wrench 1 and the processing terminal 20 because even when the transmission frequency is being used by another wireless device or noise has occurred at the same frequency as the transmission frequency, another frequency is used to transmit and receive the radio waves.

In the first embodiment described above, the LED 21 is included as the pass/fail test result report means in the processing terminal 20. However, it may be eliminated if the processing terminal 20 needs not to provide any reports. Note that in such a case, no reporting is available at the aforementioned processing terminal 20.

Furthermore, in the first embodiment, the liquid crystal display unit 4 is provided in the case 2 of the torque wrench 1. However, it can be eliminated if the torque wrench 1 needs not to check torque values during tightening operations. In such a case, the torque wrench 1 can be further reduced in size and weight.

In the first embodiment, at the time of wireless communications between the torque wrench 1 and the processing terminal 20, the torque wrench 1 transmits the identification number of the torque wrench 1 in conjunction with the measured torque value. However, if no other torque tool devices are present within the service coverage of the torque tool device and only one torque wrench 1 is used, the received information will not need to be identified and thus the identification number is not required to be transmitted. However, for example, for the processing terminal 20 to receive and process information from multiple torque wrenches 1, it is preferable to transmit the identification number in conjunction with the torque value with the torque value identifiable for each torque wrench for ease of management. Furthermore, a plurality of torque tool devices, each having a group of torque tools and processing terminals, may be used simultaneously at the same place. In this case, it is also preferable to transmit the identification number in order to prevent interference from another torque tool device and provide wireless communications between corresponding torque wrenches and processing terminals.

In the first embodiment, the pass/fail test result is reported by the LED 6 being lit at the torque wrench 1. However, it is also possible to use a light source other than LEDs. The reporting may also be carried out with buzzer being sounded or vibrations or the combination thereof.

In the first embodiment, the toggle mechanism 7 is provided in the torque wrench 1. However, if the indication on the liquid crystal display unit 4 or the reporting of the pass/fail test result at the processing terminal 20 is just enough to perform tightening at the desired torque value, the toggle mechanism 7 needs not to be included. Furthermore, with the torque wrench 1 of the first embodiment, the CPU 9 senses the operation of the toggle mechanism 7 and determines the end of a tightening operation based on an increase or decrease in the voltage outputted by the Hall element 11. However, the invention is not limited thereto. For example, it is also possible to employ another sensor or a strain gauge 12 to sense strain or a limit switch or the like.

Furthermore, in the first embodiment, the descriptions have been given to the use of 2.4 GHz band radio waves to transmit and receive information between the torque wrench 1 and the processing terminal 20. However, conventional radio waves such as several tens of MHz to several hundreds of MHz band waves may also be used.

(Second Embodiment)

With reference to the drawings, a description will now be made to a traceable torque tool device according to a second embodiment of the present invention.

In the first embodiment, to transmit and receive tightening data between the torque wrench 1 and the processing terminal 20, the in-house serial number the user can arbitrarily set is transmitted and received as the identification number of the torque wrench 1. In contrast, the second embodiment is different from the first embodiment in that the manufacturer's serial number unique to each torque wrench is used as the identification number of the torque wrench 1.

Concerning the other parts, the torque tool device of the second embodiment is configured in the same manner as the torque tool device of the first embodiment shown in FIGS. 1, 2, 3, and 4. Accordingly, no description will be made to those components of the torque tool device of the second embodiment which are commonly employed for the first embodiment.

When the torque wrench 1 is used to tighten a clamp member such as a bolt or nut in the torque tool device shown in FIG. 1, the manufacturer's serial number of the torque wrench 1 and the tightening data such as the measured torque value measured by the torque measurement means (for example, the strain gauge 12 and the CPU 9) (hereinafter referred to as tightening data) are transmitted via the first wireless communication means of the torque wrench 1 (such as the antenna 5 and the radio module 8) to the processing terminal 20. For this purpose, as the frequency to be used, for example, 2.4 GHz frequency band radio waves can be employed. The processing terminal 20 forwards the manufacturer's serial number and the tightening data of the torque wrench 1, which were received via the second wireless communication means (the antenna 22 and the radio module 24), to an externally connected information management device 30 which is made up of, for example, a-personal computer (PC) or a programmable controller (PLC). The externally connected device 30 records the manufacturer's serial number and tightening data corresponding to the information on a clamp member such as a bolt tightened (for example, information on the number that identifies the bolt or the position of the bolt being tightened, hereinafter, referred to as the bolt information). This facilitates data management even when the information on multiple torque wrenches is maintained in one externally connected device 30, because the tightening data and the associated bolt information can be recorded by each manufacturer's serial number of the torque wrenches. It is thus possible to identify the torque wrench 1 based on the bolt tightened.

Note that in the aforementioned processing, the processing terminal 20 can be configured such that the pass/fail test section 25*a* makes a pass/fail determination of whether the measured torque value is a specified torque value stored in the specified-value memory 26. In conducting the pass/fail test, the pass/fail result as well as the aforementioned tightening data and the manufacturer's serial number of the torque wrench are outputted to the externally connected device 30 for record purpose. Furthermore, the pass/fail test result can be transmitted to the torque wrench 1 via the wireless communication means, so that on the part of the torque wrench 1, the received pass/fail test result is reported to the operator by the report means 6 disposed in the case 2. This allows the operator to decide at the end of the tightening whether the tightening was properly carried out in accordance with the specified torque value.

Furthermore, if the torque wrench 1 does not include the strain gauge 12 or the like and thus measures no torque when a bolt is tightened, the tightening data to be recorded is only data that indicates the fact that the bolt was tightened. More specifically, when the bolt is tightened, the torque wrench 1 transmits only a signal indicative of the manufacturer's serial number and the completion of the tightening to the processing terminal 20. Then, after the processing terminal 20 has received the signal, the externally connected device 30 records the data (for example, the date and time of the tightening having been performed) indicative of the manufacturer's serial number and the fact that the tightening was carried out.

Figure 8:
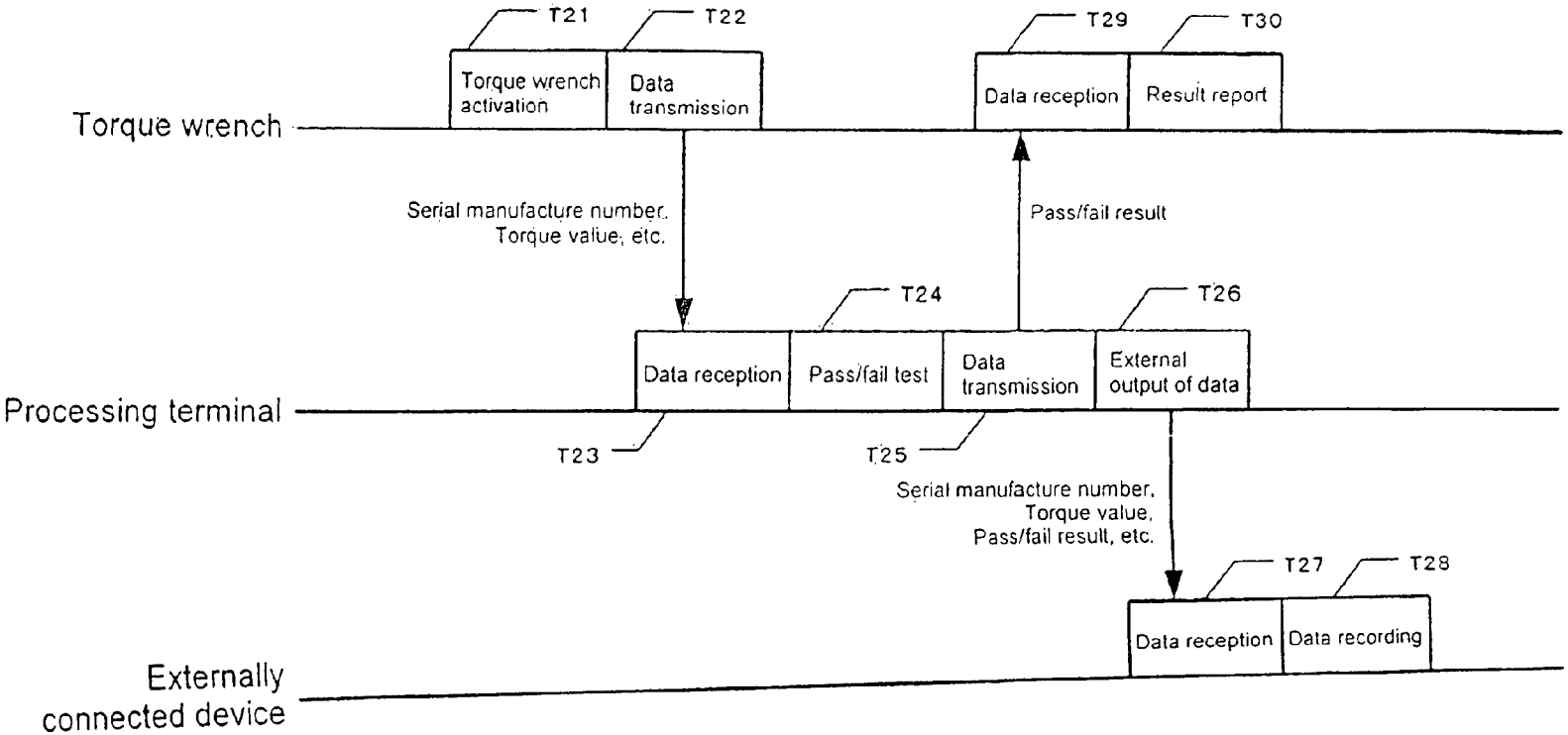
FIG. 8 is a timing chart illustrating the operation of the torque tool device shown in FIG. 1 according to the second embodiment.

With reference to the timing chart shown in FIG. 8, a description will be made to the communications of data from the torque wrench 1 to the processing terminal 20, and the flow of the transmission and recording of data from the processing terminal 20 to the external output device. The timing chart shown in FIG. 8 is made by consolidating the timing charts (1) and (2) of the first embodiment shown in FIG. 7 into one. The timing chart of FIG. 8 is different from that of FIG. 7 in that the information transmitted from the torque wrench 1 is the unique manufacturer's serial number of the torque wrench 1.

(T21) When the torque wrench 1 is used to start tightening, the torque wrench 1 is activated, and the torque value at which the bolt is tightened is measured.

(T22) The torque value measured at T21 is transmitted to the processing terminal 20 in conjunction with the manufacturer's serial number of the torque wrench 1.

(T23) and (T24); Upon reception of data, the processing terminal 20 makes a pass/fail determination of whether the measured torque value is a pre-set specified torque value.

(T25) The pass/fail test result is transmitted to the torque wrench 1.

(T26) The tightening data containing the manufacturer's serial number and the measured torque value and the pass/fail result are outputted to the externally connected device 30.

(T27) The externally connected device 30 receives the aforementioned data transmitted at T26, and then (T28)

records the data. At this time, as described above, those bolts to be tightened with the torque wrench 1 may be predetermined so as to be capable of identifying which bolts were tightened with the torque wrench 1. With this arrangement, the bolt information, the manufacturer's serial number, and tightening data are associated with each other for storage.

(T29) and (T30); According to the received pass/fail test result, the torque wrench 1 turns on the LED 6 which serves as the pass/fail test result report means of the torque wrench 1.

Note that although the pass/fail test is conducted in T24 above, it can be eliminated if the pass/fail test needs not to be performed. In that case, the pass/fail result will not be transmitted to the torque wrench 1, while the pass/fail result is not reported in T30 and the pass/fail result is not recorded in the externally connected device 30 in T28. Furthermore, as described above, if the torque wrench 1 does not also measure torque during a tightening operation, a bolt tightening completion signal is transmitted instead of the measured torque value being transmitted to the processing terminal 20. Then, the externally connected device 30 records only such data indicative of the fact that the tightening was carried out (such as date and time).

With the arrangement as described above, for example, suppose that for a series of assembly operations in a car factory production line, a torque wrench with a manufacturer's serial number ABCD is assigned to the tightening of a bolt No. 00X for fixing a seat of a car. In this case, the information on the assigned bolt is registered with the externally connected device 30. Then, when the manufacturer's serial number and the tightening data of the torque wrench with the manufacturer's serial number ABCD are received from the processing terminal 20, the tightening data is recorded in association with the bolt information. This makes it possible to check even afterwards which torque wrench was used to tighten the bolt No. 00X. It is thus possible to ensure that the bolt No. 00X was tightened with the torque wrench having the manufacturer's serial number ABCD.

Furthermore, as described above, the torque wrench 1 of the second embodiment is configured such that the manufacturer's serial number unique to each torque wrench 1 is transmitted to the processing terminal 20 in conjunction with the tightening data for record purpose in the externally connected device 30. One manufacturer's serial number is allotted to only one torque wrench and thus will never overlap the numbers of other torque wrenches, without any possibility of the number being altered or changed into a fictitious one. It is thus possible to identify one torque wrench 1 with certainty based on the manufacturer's serial number. In contrast to this, if an arbitrarily set number is given to each torque wrench, the correspondence between the number and the torque wrench is not always assured.

Figure 9:
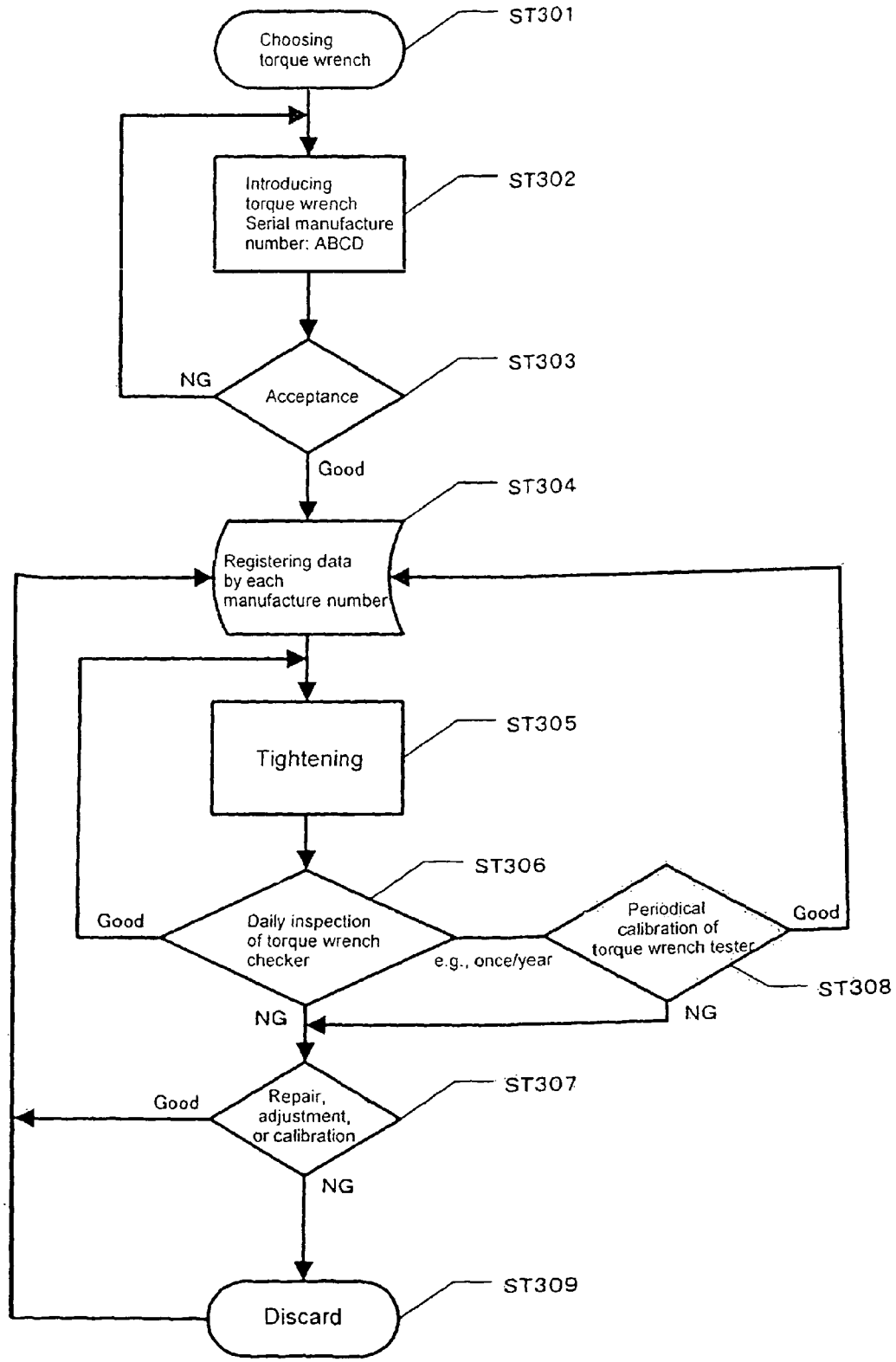
FIG. 9 is a flowchart illustrating a method for controlling the torque tool device shown in FIG. 1.

With reference to the flowchart shown in FIG. 9, a description will now be made to a management method for maintaining traceability of which tester or calibrator, placed in the upper layer of the traceability system, tested or calibrated the torque wrench 1 of the second embodiment.

First, a new torque wrench 1 is chosen and the torque wrench with the manufacturer's serial number ABCD is introduced (ST301 and ST302).

Then, at an acceptance inspection in ST303, the torque wrench with the manufacturer's serial number ABCD may be determined to properly operate and be acceptable. In this case, the manufacturer's serial number of the torque wrench 1 and the inspection result information on the aforementioned acceptance inspection are registered with the external output data management device 30. Alternatively, the number and result information are registered with the database of a tool management terminal for controlling tools such as the torque wrench 1 if the tool management terminal is available (ST304).

On the other hand, if it is determined in ST303 that the introduced torque wrench 1 cannot be accepted because of its low quality or for some other reason, the torque wrench 1 is returned to its maker to be replaced with another normal torque wrench or alternatively the returned torque wrench 1 may be repaired and then its manufacturer's serial number is registered in ST304 in the same manner as above.

When the manufacturer's serial number is registered with the external output data management device 30 or the tool management database, the tightening operation is performed. Then, following the process flow shown in FIG. 9, the tightening data is recorded in the external output data management device 30 by each manufacturer's serial number registered (ST305). After the tightening operation, as daily inspections, a torque wrench checker or a simplified tester is used to check whether the torque wrench 1 can perform tightening with a correct torque (ST306). If the daily inspections show that the torque wrench 1 performs tightening with the correct torque (Good), the torque wrench 1 is used again for tightening operations. On the other hand, if the torque wrench 1 was found to be improper (NG), then the torque wrench 1 is repaired, adjusted, or calibrated (ST307).

If the torque wrench 1 is found to be capable of performing tightening with a correct torque as the result of the repair or adjustment, the manufacturer's serial number of the torque wrench 1 as well as the information on the torque checker used when it was determined NG and the information on the repair or adjustment are recorded either in the external output device 30 or the tool management database (ST304). On the other hand, if the torque wrench 1 cannot perform proper tightening operations even after the repair or adjustment, the torque wrench 1 is discarded (ST309), while the fact that it was discarded is registered with the data associated with the manufacturer's serial number of the torque wrench 1 (ST304).

Furthermore, instead of the daily inspection in ST306, for example, at annual intervals, a torque wrench tester may be used for periodical calibrations of the torque wrench 1 (ST308). The torque wrench tester can measure the accuracy of the torque wrench more correctly than the torque wrench checker. The calibration result provided by the torque wrench tester is processed in the same manner as the inspection result by the aforementioned torque wrench checker. Thus, the information on which torque wrench tester was used for calibration and the information on the calibration result is registered with the data associated with each manufacturer's serial number.

Figure 10:
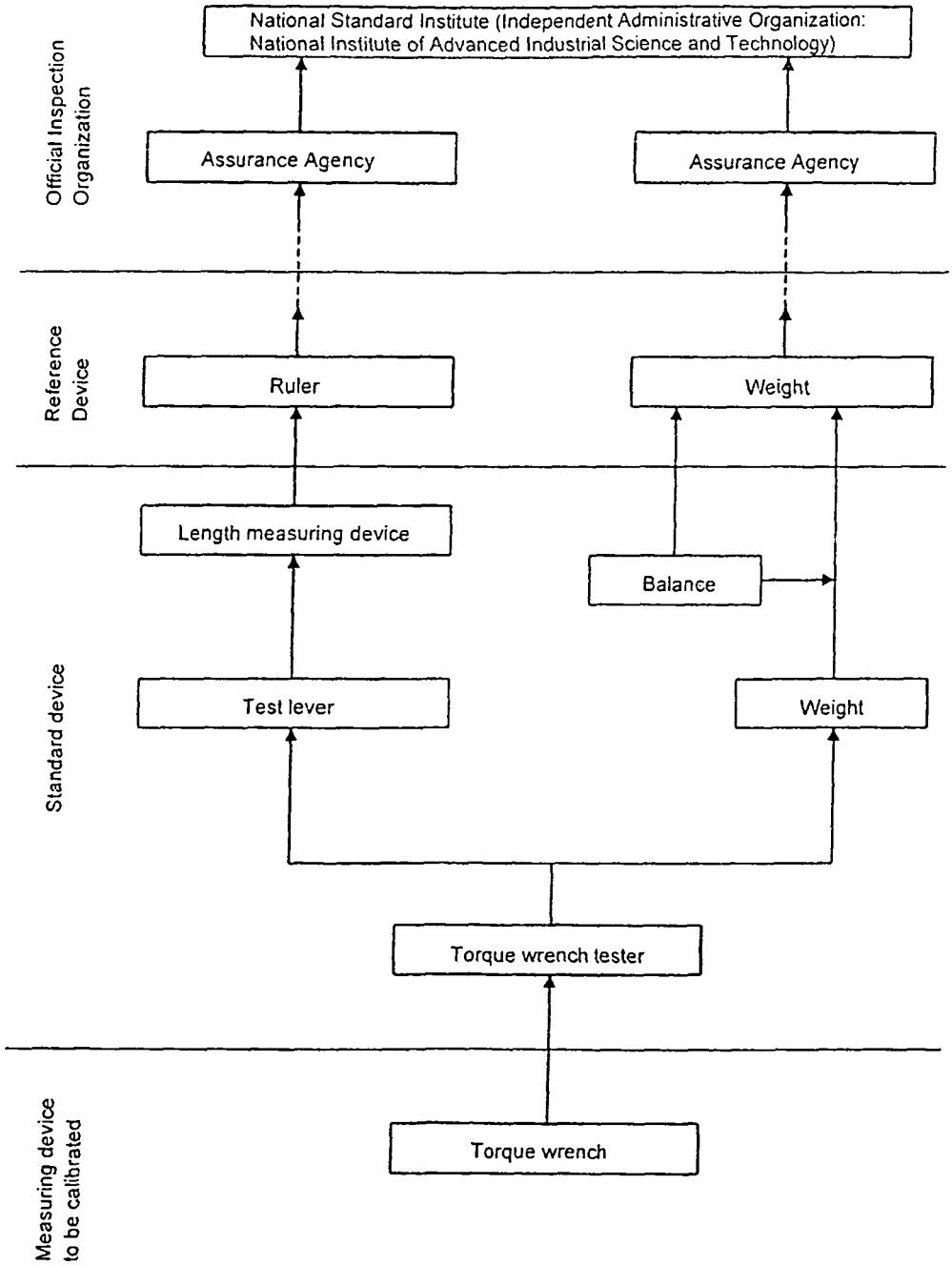
FIG. 10 is a systemic traceability diagram which can be followed by a torque wrench of the second embodiment.

This makes it possible to identify which torque wrench checker or torque wrench tester was used to inspect or calibrate the torque wrench 1 identified by the manufacturer's serial number. This also ensures that the torque wrench 1 has been adjusted or calibrated using a device whose accuracy is guaranteed by the traceability system with the National Standards Institute at its top, which provides standards for all the torque devices shown in FIG. 10. Thus, according to the torque wrench 1 of the present embodiment, it is always possible to verify that the bolt tightened using the torque wrench is tightened with a proper torque wrench that has been calibrated in accordance with the traceability system.

Furthermore, as described above, to transmit and receive the tightening data such as the measured torque value or the information such as the manufacturer's serial number, the torque wrench 1 and the processing terminal 20 of the second embodiment can use, for example, one of the ISM band or 2.4

GHz band frequencies that can be commonly used in the countries all over the world. It is thus possible to provide high-speed communications between the torque wrench 1 and the processing terminal 20. Accordingly, the time required for communications will not be increased even when an increased amount of information is transmitted from the torque wrench 1 to the processing terminal 20 in order to transmit identification information such as the manufacturer's serial number in addition to the measured torque value. In particular, even when the processing terminal conducts the pass/fail test and then reports the result at the torque wrench 1, it will not take a long time to report the pass/fail result because the information is transmitted and received using the 2.4 GHz band frequencies. For this reason, the operator can obtain the pass/fail result immediately. On the other hand, the present invention is not limited to the radio wave frequencies used for transmitting and receiving information between the torque wrench 1 and the processing terminal 20 according to this embodiment. It is also possible to employ any frequency band so long as it can realize such a communication speed as will not prevent quick tightening operations.

As described above, according to the torque tool device of the second embodiment, the torque wrench 1 transmits the manufacturer's serial number unique to itself from the torque wrench 1 to the processing terminal 20. This makes it possible to allow the externally connected information management device 30 to record the tightening data such as the measured torque value corresponding to the manufacturer's serial number. It is thus possible to identify positively which torque wrench provided the tightening data. Furthermore, according to the torque tool device of the present embodiment, the manufacturer's serial number of the torque wrench 1 and the tightening data can be recorded corresponding to the information on the bolt tightened, thereby allowing for identifying which torque wrench was used to tighten the bolt in question. It is thus possible to build a traceability system from the tightened bolt to the National Standard Institute that provides standards for all the torque devices.

In the embodiments of the present invention, the torque wrench was used as a torque tool. However, the invention is not limited thereto. The invention is also applicable similarly to other torque tools such as torque drivers.

As described above, according to the torque tool device of the present invention, there is no need to include, in the torque tool itself, a device for making a pass/fail determination of whether the measured torque value is adequate. This allows for reducing the torque tool in size and weight and providing improved operation efficiency. Furthermore, all the information processing such as the pass/fail test or the recording of the measured torque value is performed on the part of the processing terminal. This eliminates the need for the operator to do any operation other than the tightening operation on the part of the torque tool, thereby allowing the tightening operations to be consecutively performed at high speeds. Furthermore, the processing terminal conducts the pass/fail test to see if the adequate torque is available, thus allowing for performing the tightening at the specified torque value with accuracy. Furthermore, the processing terminal 20 can transmit the pass/fail test result as well as externally output the information containing torque values and their pass/fail test results to the externally connected device 30 that is made up of a personal computer (PC) or a programmable controller (PLC). The externally outputted information is managed or analyzed by a personal computer or the like.

Furthermore, according to the torque tool device of the present invention, 2.4 GHz band radio waves are used to transmit and receive information and thus the wireless communications can be provided at very high speeds. Thus, as soon as the tightening of a clamp member such as a bolt is completed using the torque tool, it is possible to obtain a determination of whether the tightening was adequate, almost at the same time as the tightening is completed. It is thus possible to perform tightening operations on bolts consecutively at high speeds. Furthermore, the use of 2.4 GHz band radio waves that are also used as the ISM band in the countries all over the world makes it possible to use them globally even outside Japan without changing the frequencies.

The invention claimed is:

1. A torque tool device, comprising:

a torque tool having torque measurement means for measuring a torque value at which a clamp member is tightened, first wireless communication means capable of transmitting information containing at least a measured torque value provided by the torque measurement means and receiving at least report information, first report means for reporting the report information received by the first wireless communication means, and a toggle mechanism configured to sense that a tightening torque has reached a predetermined value by changing a condition of the toggle mechanism from an inactive condition in a normal position to an operating condition; and a tightening information processing terminal having second wireless communication means capable of transmitting and receiving information to/from the first wireless communication means, and information processing means for transmitting and receiving the information to/from the second wireless communication means, the information processing means having a pass/fail test section for making a pass/fail determination of whether the measured torque value contained in the information received from the second wireless communication means is within a range of a pre-set specified torque value, wherein upon reception of the information of the measured torque value by the second wireless communication means, the information processing means allows the pass/fail test section to conduct a pass/fail test and then the second wireless communication means to transmit a result of the pass/fail test as the report information to the first wireless communication means, and the first report means reports based on the result of the pass/fail test of the report information received by the first wireless communication means, and the first wireless communication means transmits the information containing the measured torque value when the toggle mechanism is brought back to the normal position after the tightening torque reaches the predetermined value and the toggle mechanism is activated.

2. The torque tool device according to claim 1, wherein the first wireless communication means and the second wireless communication means transmit and receive over a 2.4 GHz frequency band.

3. The torque tool device according to claim 2, wherein the first wireless communication means and the second wireless communication means transmit and receive information using a frequency hopping scheme.

4. The torque tool device according to claim 2, wherein the first wireless communication means and the second wireless communication means transmit and receive information over the 2.4 GHz frequency band radio wave to conduct high-speed communications between the torque tool and the tightening information processing terminal.

5. The torque tool device according to claim 1, wherein the tightening information processing terminal has second report means for reporting the result of the pass/fail test.

6. The torque tool device according to claim 1, wherein the information transmitted from the first wireless communication means includes the measured torque value and an identification number of the torque tool, and the tightening information processing terminal determines whether the identification number contained in the received information has been pre-stored in the information processing means, when the identification number is a stored identification number, then the measured torque value contained in the received information is subjected to the pass/fail test, and when the identification number is not the stored identification number, then the pass/fail test is not conducted.

7. The torque tool device according to claim 6, wherein the identification number is a manufacturer's serial number of the torque tool.

8. The torque tool device according to claim 1, wherein the torque tool transmits, as the measured torque value, a maximum torque value measured until tightening is released after starting to measure the torque value.

9. The torque tool device according to claim 1, wherein the specified torque value serving as a reference to the pass/fail test can be altered.

10. The torque tool device according to claim 1, wherein the report means reports by either light, sound, or vibration or a combination thereof.

11. The torque tool device according to claim 1, wherein the tightening information processing terminal is capable of transmitting the received information and the result of the pass/fail test to an information management computer.

12. The torque tool device according to claim 11, wherein a clamp member including a bolt to be tightened with the torque tool is specified, and the received information and the result of the pass/fail test correspond to information of the clamp member in the information management computer.

13. The torque tool device according to claim 1, wherein the first report means reports an indication that the result of the pass/fail test was not successfully received when the result of the pass/fail test is not received from the tightening information processing terminal within a specified period of time after the information containing the measured torque value has been sent.

14. The torque tool device according to claim 1, wherein the torque tool further comprises a Hall element and a magnet configured to sense an operation of the toggle mechanism.

15. The torque tool device according to claim 14, wherein the magnet is disposed on a front actuation body of the toggle mechanism, and the Hall element is disposed at a location corresponding to the magnet inside a case which holds circuits of the torque tool.

16. The torque tool device according to claim 1, wherein the first wireless communication means transmits the information containing the measured torque value only when the toggle mechanism is activated.

* * * * *